US005381948A

United States Patent [19]

Coalier et al.

[11] Patent Number: 5,381,948

[45] Date of Patent: Jan. 17, 1995

[54] PACKAGING OF POLYGONAL SECTION MADE OF A SHEET-TYPE MATERIAL AND BLANK FOR PRODUCING SUCH A PACKAGING

[75] Inventors: Guy Coalier, Noce; Jean-Yves Bacques, Paris, both of France

[73] Assignee: Otor, Paris, France

[21] Appl. No.: 51,399

[22] Filed: Apr. 23, 1993

[30] Foreign Application Priority Data

Apr. 24, 1992 [FR] France ..... 92 05069

[51] Int. Cl.[6] ..... B65D 5/02; B65D 5/42

[52] U.S. Cl. ..... 229/109; 229/164; 229/182.1; 229/933

[58] Field of Search ..... 229/40, 109, 164, 82.1, 229/933, 935; 206/427

[56] References Cited

U.S. PATENT DOCUMENTS

| | | | |
|---|---|---|---|
| 2,433,676 | 12/1947 | Ringler | 229/109 |
| 2,529,725 | 11/1950 | Currie | 229/935 |
| 2,680,556 | 6/1954 | Currie | 206/427 |
| 2,987,176 | 6/1961 | Ringler | 229/40 |
| 3,627,193 | 12/1971 | Helms . | |
| 3,688,972 | 9/1972 | Mahon | 206/427 |
| 3,986,658 | 10/1976 | Arrveson et al. | 229/40 |
| 4,378,877 | 4/1983 | Battesman et al. | 229/40 |
| 4,782,943 | 11/1988 | Blackman | 229/933 |
| 4,919,266 | 4/1990 | McIntosh, Jr. et al. | 206/427 |
| 5,147,271 | 9/1992 | Bacques et al. . | |

FOREIGN PATENT DOCUMENTS

| | | | |
|---|---|---|---|
| 2447872 | 10/1980 | France | 229/40 |
| 2650991 | 2/1991 | France | 206/427 |
| 2456890 | 12/1976 | Germany . | |
| 2201396 | 1/1988 | United Kingdom . | |

*Primary Examiner*—Gary E. Elkins
*Attorney, Agent, or Firm*—Larson and Taylor

[57] ABSTRACT

Packaging made of sheet-type material, such as cardboard or corrugated cardboard, of at least approximately parallelepipedal shape and blank for producing it. The faces (1 to 4) have different heights, with the faces of greater height having a width which is at most equal to the distance separating two consecutive faces of greater height when the packaging is a blank. Saving of material on cutting out the blanks by interfitting of the flaps and/or tabs of two consecutive blanks is also effected.

17 Claims, 9 Drawing Sheets

PACKAGING OF POLYGONAL SECTION MADE OF A SHEET-TYPE MATERIAL AND BLANK FOR PRODUCING SUCH A PACKAGING

The present invention relates to a packaging made of cardboard, corrugated cardboard or similar sheet-type material, having a polygonal section, and particularly a rectangular overall section, as well as a blank of such a sheet-type material for producing the packaging.

It is known that the unique blank from which such packagings are formed comprises a series of flaps connected to each other by parallel folding lines and provided laterally with tabs, connected respectively to the flaps by folding lines perpendicular to the folding lines connecting the flaps together and intended to form the bottom and the lid of the packagings. The free edge of one of the outermost flaps of the group is provided with a tongue connected to the outermost flap by a folding line parallel to those connecting the flaps and intended to be fixed against the free edge of the opposite outermost flap.

Known packagings of this type are called "American boxes" and they have a section (transversely to the flaps) which is generally rectangular. The result is then that all the flaps and all the tabs are also of square or rectangular shape, all the tabs having, transversely to the folding lines which connect them to the flaps, the same width, chosen so as to be at least approximately equal to half the width of the section of the box.

These known American boxes are manufactured by a cardboard-making manufacturer, who from the blank, forms a flattened box preform by folding the blank about the central folding line of the group of flaps and fixing the tongue to the opposite outermost flap. During this operation, the blank folded about the central folding line is guided laterally by stop-pieces bearing against the free edges of the lid and bottom tabs. It will be noted that, since all the tabs have the same width, the free edges of superimposed tabs are then themselves superimposed, so that each of the stop-pieces bears against the free edges of these superimposed tabs. The result of this is an at least approximate squareness of the preform at the time of fixing the tongue to the superimposed outermost flap.

After this operation, the preform therefore has a flattened parallelogram-shaped section, the lateral tabs extending respectively the corresponding flaps towards the outside. These flattened preforms are then delivered to a user, who, in order to house therein objects to be packaged, gives them their shape by expansion parallel to the flattened diagonal of the parallelogram, then folds over and glues the tabs in order to form the bottom, and, after filling, the lid of the box.

The bottom and the lid of the box are then each formed by two small non-contiguous opposite internal rectangular tabs and by two large contiguous opposite external rectangular tabs.

The boxes produced in this way form packagings which are entirely closed, which is often not necessary when the products packaged in these boxes are themselves enclosed in a container (for example a bottle).

The object of the present invention is to improve an American box as described above, particularly so as to save on material (cardboard, corrugated cardboard, etc.) during its manufacture.

With this aim in view, the present invention essentially proposes a packaging made of sheet-type material, such as cardboard or corrugated cardboard, of at least approximately parallelepipedal shape, comprising:

at least four lateral faces, which are rectangular or substantially rectangular, identical in pairs and connected together via first parallel folding lines, two opposite lateral faces having a height (H) which is greater than the height (h) of the two other opposite lateral faces;

a bottom consisting of tabs connected to the lateral faces by second folding lines orthogonal to the first folding lines; and a lid formed by tabs connected to the lateral faces of greater height by third folding lines, orthogonal to the first folding lines; characterised in that:

the width (x) of the parts of the lateral faces of greater height, which protrude in relation to the lateral faces of smaller height, is less than the distance (X) separating the protruding parts, when the packaging is laid flat;

the bottom of the packaging is formed by two small opposite lower tabs, respectively attached to the lateral faces of smaller height of the whole length of the second folding lines, and two large opposite external tabs, respectively attached to the lateral faces of greater height over the whole length of the second folding lines, these two large external tabs covering substantially the entire or the entire surface of the bottom, being contiguous along their free edges located on the opposite side to the second folding lines, and having lateral edges which are free with respect to the lateral edges of the small adjacent flap internal edges.

A packaging is thus obtained in the shape of a basket, in which two opposite faces are open-worked and which can be obtained from blanks, the protruding parts of which interpenetrate each other, so that a considerable amount of material is saved.

It will be noted that, since according to the invention the flaps have different heights, it is necessary to consequently modify the abovementioned stop-pieces for guiding and for squareness, in order to adapt them to the packaging in accordance with the present invention, or else, preferably, use a different method for producing a box, for example of the type of that described in the American Patent U.S. Pat. No. 4,932,930.

Use is advantageously made of one and/or the other of the following arrangements:

the width (d) of the small internal tabs, perpendicularly to the corresponding second folding lines, is less than that (D) of the large external bottom tabs, the ends of the large external bottom tabs comprise cut-outs in the free edges of these tabs, at least in the vicinity of the second folding lines, the width (L) of the lateral faces of greater height is greater than the width l of the lateral faces of smaller height, the packaging is made of corrugated cardboard, having a thickness between of the order of 2 mm and of the order of 5 mm, at least in the vicinity of its bottom, it has a rectangular section with cut-off corners, at least in the vicinity of its bottom, it has a rectangular section with rounded corners.

Thus, by virtue of its arrangements, it is particularly possible to provide blanks for producing the packaging, in which the tabs of the two successive blanks also interpenetrate each other, so that an amount of additional sheet-type material is saved.

The invention also proposes a blank of sheet-type material, made of cardboard or corrugated cardboard, for producing a packaging having an at least approximately parallelepipedal shape, the blank comprising:

a series of at least four rectangular or substantially rectangular flaps, identical in pairs, connected to each other by first parallel folding lines, two non-consecutive flaps having a height (H), perpendicularly to the second folding lines, greater than the height (h) of the two other non-consecutive flaps;

a first group of lateral tabs arranged on one side of the series of flaps, connected to this series by second folding lines perpendicular to the first folding lines and intended to form the bottom of the packaging, and a second group of lateral tabs, intended to form the lid of the packaging, connected to the flaps of greater height by third folding lines, orthogonal to the first folding lines; characterised in that:

the width (x) of the parts of the flaps of greater height which protrude in relation to the flaps of smaller height is less than the distance (X) separating the protruding parts;

the first group of lateral tabs comprises two small tabs, respectively attached to the flaps of smaller height of the whole length of the second folding lines and two large tabs, respectively attached to the flaps of greater height over the whole length of the second folding lines, the lateral edges of the tabs of the first group being free, respectively, with respect to the lateral edges of the adjacent tabs located opposite.

Advantageously, at least in the vicinity of the second folding lines, the width of the flaps of greater height is greater than the width of the flaps of smaller height.

In preferred embodiments, use is furthermore made of the following arrangements:

the width (d) of the small tabs of the first group, perpendicularly to the corresponding second folding lines, is less than that (D) of the large tabs of the first group, the blank is made of corrugated cardboard having a thickness between of the order of 2 mm and of the order of 5 mm, at least in the vicinity of the second folding lines, the width (L) of the flaps of greater height is greater than the width (l) of the flaps of smaller height, the lateral ends of the large tabs of the first group comprise cut-outs in the free edges of these tabs, the depth (p) of the cut-outs, parallel to the free edges of the large tabs of the first group, is at most equal to the width (d) of the small tabs of the first group, the series of flaps comprises additional narrow flaps which do not bear any tabs at their ends, at least some of the tabs having, in the vicinity of the folding line connecting them to the corresponding flap, the shape of the section of the packaging obtained from the blank.

When such a blank is intended to form a box with cut-off (octagonal section) or rounded corners, there are provided in the series of flaps additional narrow flaps which do not bear any tabs at their ends. In contrast, at least some of the tabs of the first group have, in the vicinity of the folding line connecting them to the corresponding flap, the shape of the section of the box obtained from the blank.

The invention also proposes a method for cutting out identical blanks such as those described hereinabove, in a sheet or strip or corrugated cardboard, characterised in that two blanks cut out successively are turned through 180° in their plane with respect to each other, the protruding parts of the flaps of greater height of one of the blanks being interfitted with the protruding parts of the flaps of greater height of the other of the blanks, and in that spaces between the lateral free edges of the flaps of greater height of two opposite consecutive blanks are cut out and removed so that the outermost lateral external edges of the two opposite consecutive blanks are aligned.

In addition, two blanks cut out successively can be turned in their plane through 180° with respect to each other, the small tabs and the large tabs of the first group of one of the blanks being located respectively opposite the large tabs and small tabs of the first group of the other of the blanks, the small and large tabs suitable for forming the bottom being contiguous all along the free edges of the small tabs opposite the second folding lines.

The blanks are advantageously cut out, the first folding lines being parallel to the lines of corrugation of the corrugated cardboard.

In another embodiment, the first folding lines are perpendicular to the lines of corrugation of the corrugated cardboard.

The figures of the attached drawing will clearly reveal how the invention can be produced. In these figures, identical references denote similar elements. In addition, for simplicity and for clarity, identical references have been used for the flaps and tabs of the blanks and for the faces or face parts of the corresponding boxes.

Figure 1:
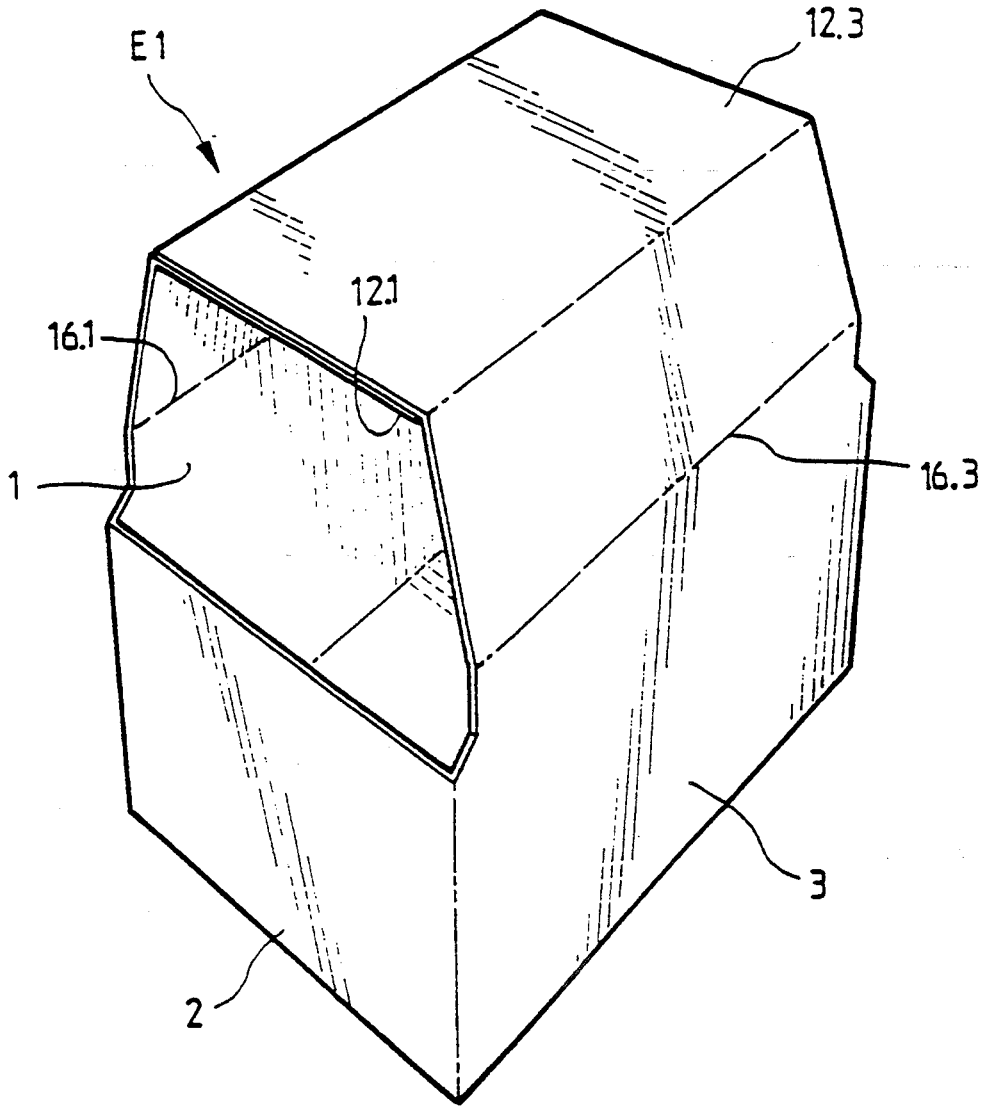
FIGS. 1 and 2 are views in perspective, respectively from above and from below, of an illustrative embodiment of a packaging in accordance with the present invention.
Figure 2:
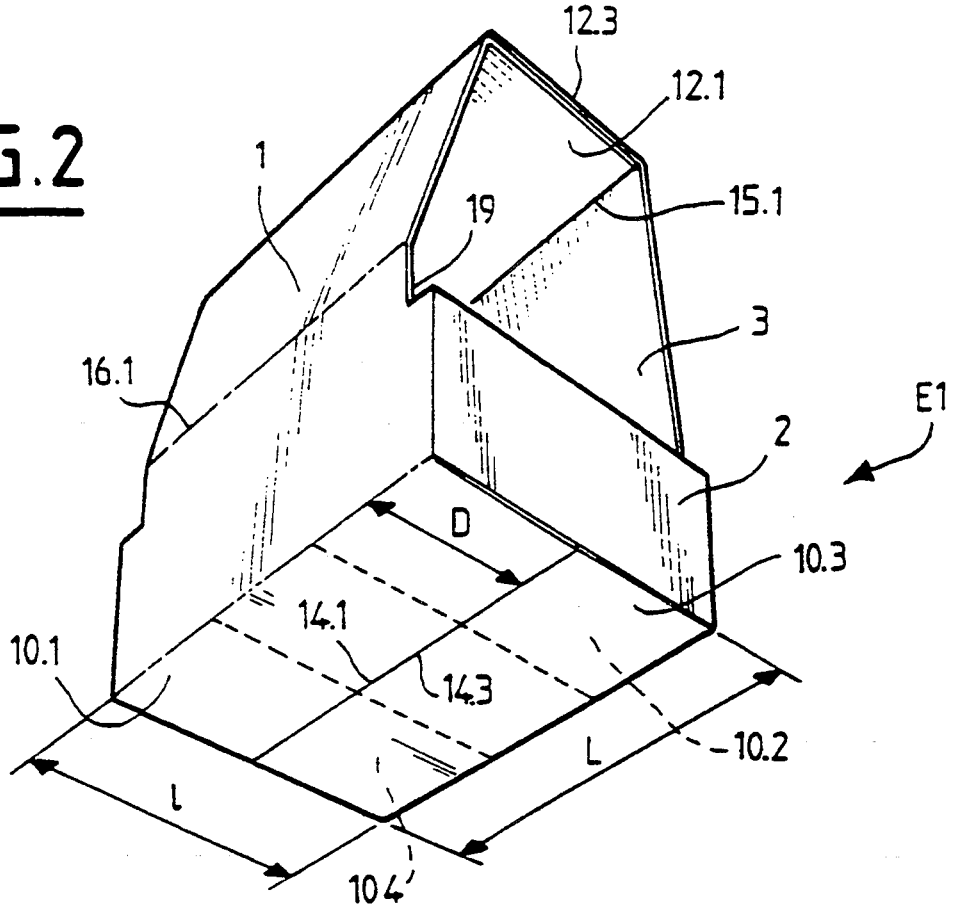

Packaging E1, in accordance with the invention and shown by FIGS. 1 and 2, is substantially parallelepipedal with a rectangular section. This rectangular section has a length L and a width l.

Figure 3:
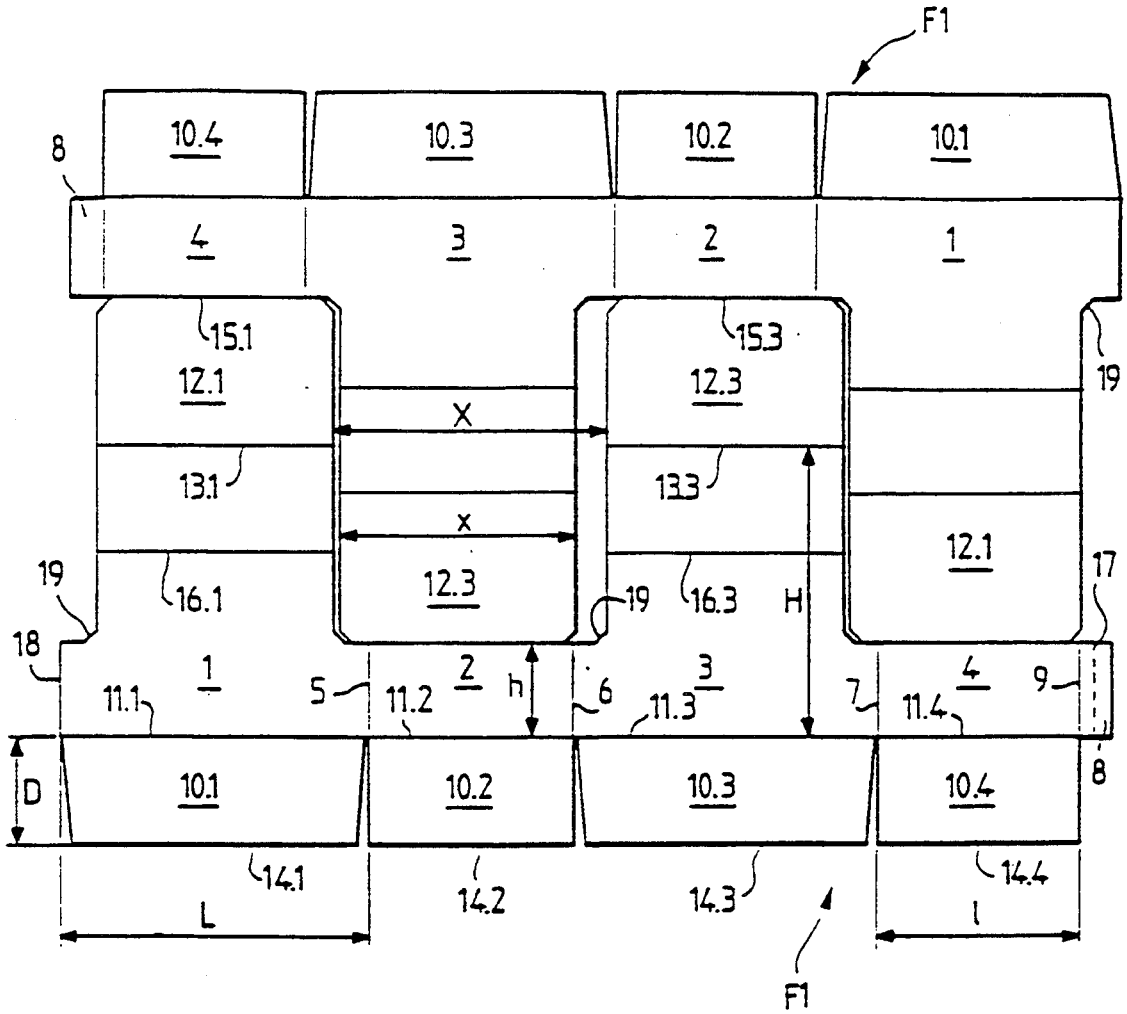
FIG. 3 shows, laid flat and arranged in an interfitted manner, two cardboard blanks, each of which makes it possible to produce the packaging of FIGS. 1 and 2.

In order to produce the packaging E1, the first step is to take one of the two identical blanks F1, shown by FIG. 3.

Each blank F1 of sheet-type material, for example of cardboard or corrugated cardboard, shown by FIG. 3, comprises a series of four aligned flaps 1, 2, 3, and 4, connected in pairs by preformed and parallel folding lines 5, 6 and 7. These parallel folding lines 5, 6 and 7 are respectively arranged between the flaps 1 and 2, 2 and 3, and 3 and 4. A tongue 8 is arranged along the free edge of the outermost flap 4 of the group of flaps 1 to 4, which tongue is connected to the outermost flap 4 by a folding line 9, parallel to the folding lines 5, 6 and 7.

Moreover, tabs 10.1, 10.2, 10.3 and 10.4 are provided on one side of each flap 1 to 4. Each lateral tab 10.1 to 10.4 is hinged to the corresponding flap 1 to 4 by a preformed folding line 11.1 to 11.4. The folding lines 11.1 to 11.4 are aligned and perpendicular to the folding lines 5, 6 and 7. Perpendicularly to the folding lines 11.1 to 11.4, the height H of the flaps 1 and 3 is greater than the height h of the flaps 2 and 4, the flaps 1 and 3, on the one hand, and 2 and 4, on the other hand, being identical. Moreover, the width x of the parts of the flaps 1 and 3 which protrude beyond the flaps 2 and 4 is smaller than the distance X separating the opposite edges of these protruding parts. In addition, the tabs 10.1, 10.3, 10.2 and 10.4 are identical. The length of each of the tabs 10.1 to 10.4, parallel to the corresponding preformed folding line 11.1 to 11.4, is equal to the corresponding dimension L or l of the flap 1 to 4 to which the tab is connected. At the end of the flaps 1 and 3, opposite the tabs 10.1 and 10.3, there is hinged a tab 12.1 or 12.3 respectively, hinged about a folding line 13.1 or 13.3 respectively. The folding lines 13.1 and 13.3 are aligned and perpendicular to the folding lines 5 to 7.

Thus, a blank F1 comprises two large flaps 1 and 3, to which there are respectively associated two large tabs 10.1 and 10.3, on the one hand, and two tabs 12.1 and 12.3, on the other hand, as well as two small flaps 2 and 4, to which there are respectively associated two small tabs 10.2 and 10.4. The part of the large flaps 1 and 3 protruding from the flaps 2 and 4, narrower than the base of the large flaps, is connected to this base by a discontinuity 19.

The width D of each of the small and large tabs 10.1 to 10.4 is approximately equal to half the width 1 of the packaging E1. The result of this is that the free edges 14.1 to 14.4 of the tabs 10.1 to 10.4 are aligned. Likewise, the free edges 15.1 and 15.3 of the tabs 12.1 and 12.3 are aligned. A prefolding line 16.1 or 16.3, respectively, parallel to the folding lines 11.1, 13.1 and 11.3, 13.3, is possibly provided in the flaps 1 and 3.

In order to produce the packaging E1 of FIGS. 1 and 2 from a blank F1, there is applied on the tongue 8 of the latter (or on the flap 1, along its free edge 18) at least one line of adhesive 17, the blank F1 is then folded over about the folding line 6 and the tongue 8 is fixed to the flap 1, in the vicinity of the free edge 18.

A preform (not shown) of the packaging E1 is thus obtained, the preform having a section in the shape of a flattened parallelogram, with the tabs 10.1 to 10.4 and 12.1 and 12.3 extending the flaps 1 to 4 outwards. In this preform, the aligned free edges 14.1 and 14.2 of the large and small tabs 10.1 and 10.2 are superimposed on the aligned free edges 14.3 and 14.4 of the large and small tabs 10.3 and 10.4. Likewise, the aligned free edges 15.1 and 15.3 of the large tabs 12.1 and 12.3 are superimposed. This superposition enables lateral stop-pieces (not shown) to guide and square the preform at the time of fixing the tongue 8 to the flap 1, the stop-pieces interacting respectively with the superimposed free edges 14.1, 14.2 and 14.3, 14.4, on the one hand, and with the superimposed free edges 15.1 and 15.3, on the other hand.

At the time of using the packaging, the preform is put into shape and the bottom is formed by the folding over, about the folding lines 11.1 to 11.4, of the tabs 10.1 to 10.4 which are fixed to each other, for example by gluing.

The two small tabs 10.2 and 10.4 are arranged on the inside of the packaging, while the two large tabs 10.1 and 10.3 are outside and cover, the entire surface of the bottom of the packaging (see FIG. 2).

As can be seen in FIG. 2, the free edges 14.1 and 14.3 of the large tabs 10.1 and 10.3 are then contiguous. After filling the packaging with the objects which it is to contain, the lid is formed by folding over the tabs 12.1 and 12.3 about folding lines 13.1 and 13.3, and then fixing the tabs together, with possibly a slight folding of the flaps 1 and 3 about the folding lines 16.1 and 16.3.

FIG. 3 depicts the arrangement of two successive blanks F1, cut out in a sheet or a strip of cardboard or corrugated cardboard.

As can be seen, in order to save on material of the sheet or of the strip, the two successive blanks F1 are turned in their plane through 180° with respect to each other, so that the flaps 1 and 3 of one blank are located opposite the flaps 4 and 2 of the other blank, that is to say that the protruding parts of the flaps 1 and 3 of the two blanks 1 interpenetrate each other.

Figure 5:
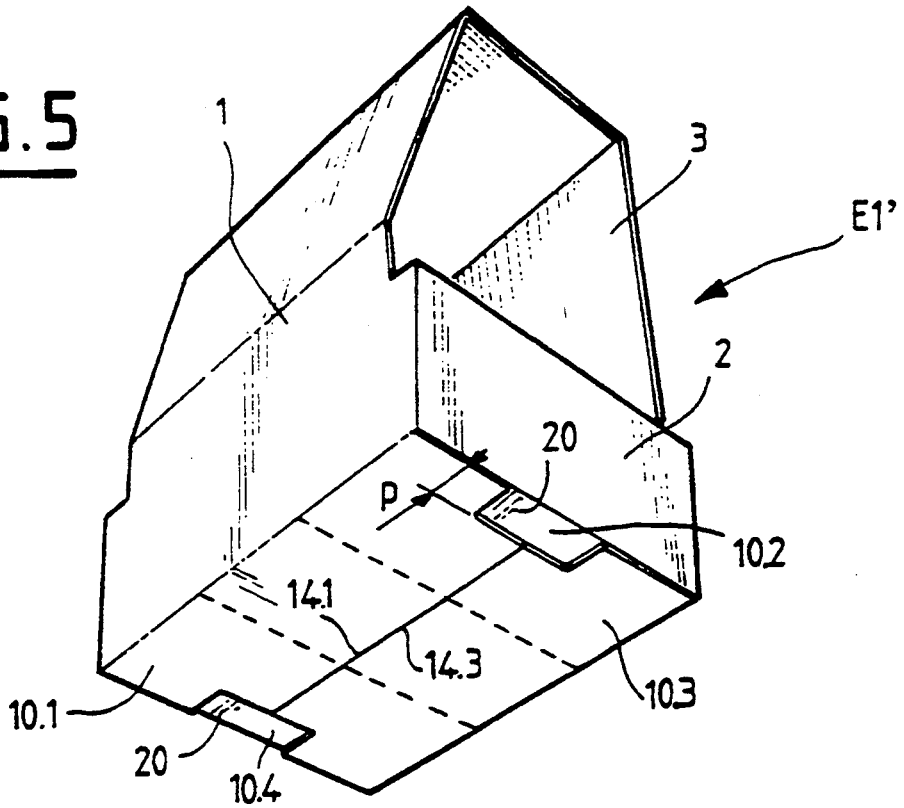
FIG. 5 is a view in perspective from below of the packaging obtained by employing a blank of FIG. 4.
Figure 4:
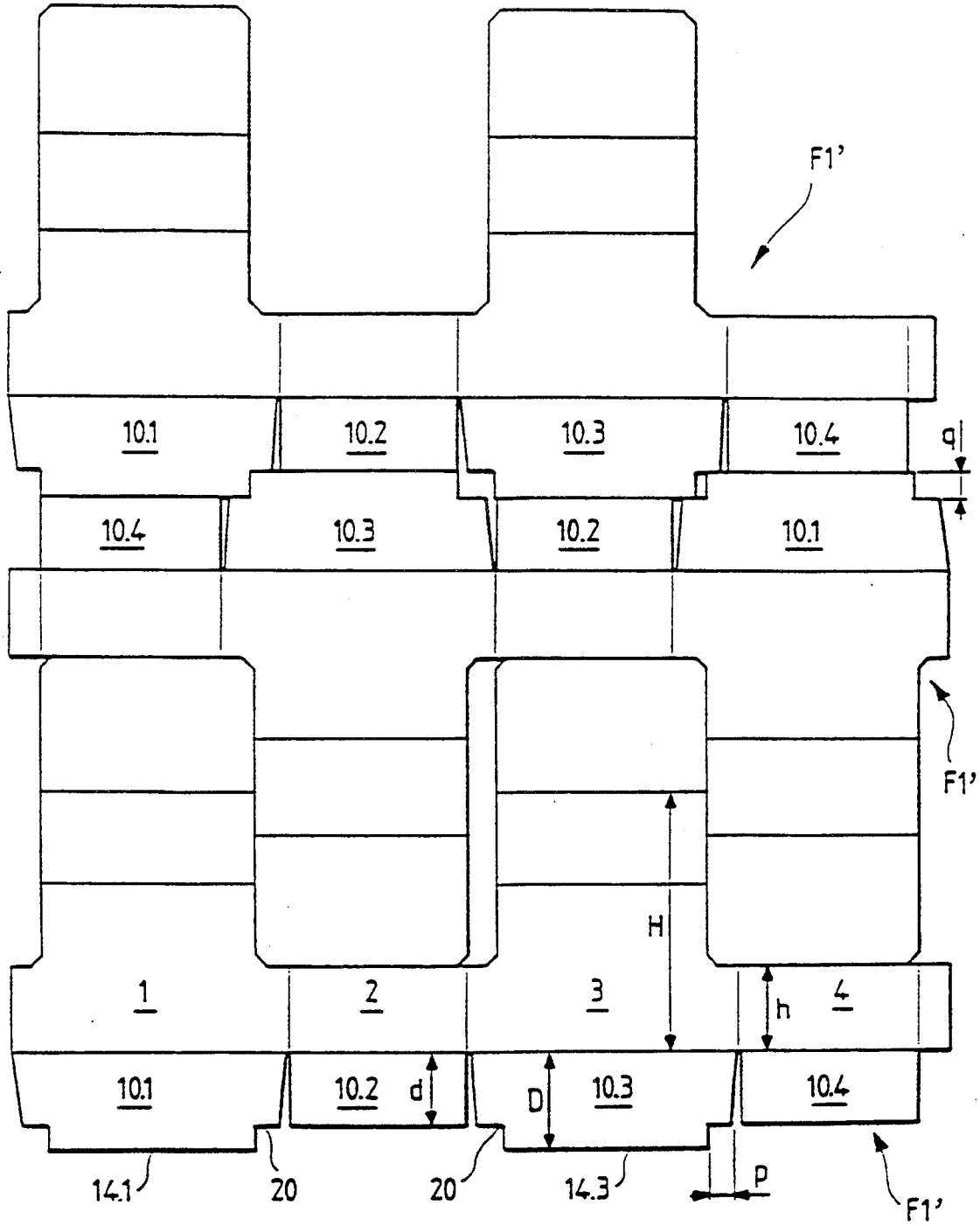
FIG. 4 shows, laid flat and arranged in an interfitted manner, three cardboard blanks different from those of FIG. 3, each of which makes it possible to produce a packaging which is slightly different from that of FIGS. 1 and 2.

FIGS. 4 and 5 respectively show a variant F1′ of the blank F1 and the corresponding variant E1′ of the packaging E1, making it possible to further increase the amount of material saved.

With this purpose in view, in this embodiment variant, the blank F′1 and the packaging E1′ are respectively identical to the blank F1′ and to the packaging E1, except with regard to the following points:

the small internal tabs 10.2 and 10.4, instead of having the width D of the large external tabs 10.1 and 10.3, have a width d which is less than D;

the ends of the large external tabs 10.1 and 10.3 comprise cut-outs 20 in the free edges 14.1 and 14.3 of the large external tabs;

the depth p of the cut-outs 20, parallel to the contiguous free edges 14.1 and 14.3 of the large external tabs 10.1 and 10.3 is less than the said width d of the small internal tabs 10.2 and 10.4.

FIG. 5 shows the bottom of the packaging E1′, obtained in this way. It can be seen therein that, when the large external tabs 10.1 and 10.3 form the outside of the bottom of the packaging E1′, the cut-outs 20 of the tabs are located opposite in pairs, in order to form two double cut-outs 20 in the bottom. Since the depth p of the cut-outs 20 is less than the width d of the small tabs 10.2 and 10.4, each of the double cut-outs 20 is closed off by the small corresponding tab 10.2, 10.4.

Moreover, as illustrated by FIG. 4 in its upper part, by virtue of the specific features mentioned hereinabove, it is possible to interfit two consecutive blanks F1′ by their tabs in a sheet or a strip of cardboard or of corrugated cardboard, in order to save on material on cutting out the blanks.

FIG. 4 shows, in the upper part, an example for interfitting the tabs 10.1 to 10.4 of a blank F1′ with the tabs 10.1 to 10.4 of another blank F1′, turned through 180°. It is thus possible to arrange the large tabs 10.1 and 10.3 of one of the blanks F1′ opposite the small tabs 10.2 and 10.4 of the other of the blanks and to save a strip of material (cardboard, corrugated cardboard) of width g.

As illustrated by FIG. 4, it can therefore be seen that the successive blanks F1' can be turned through 180° in their plane in order to interfit successively by their flaps 1 to 4 or by their tabs 10.1 to 10.4.

Figure 6:
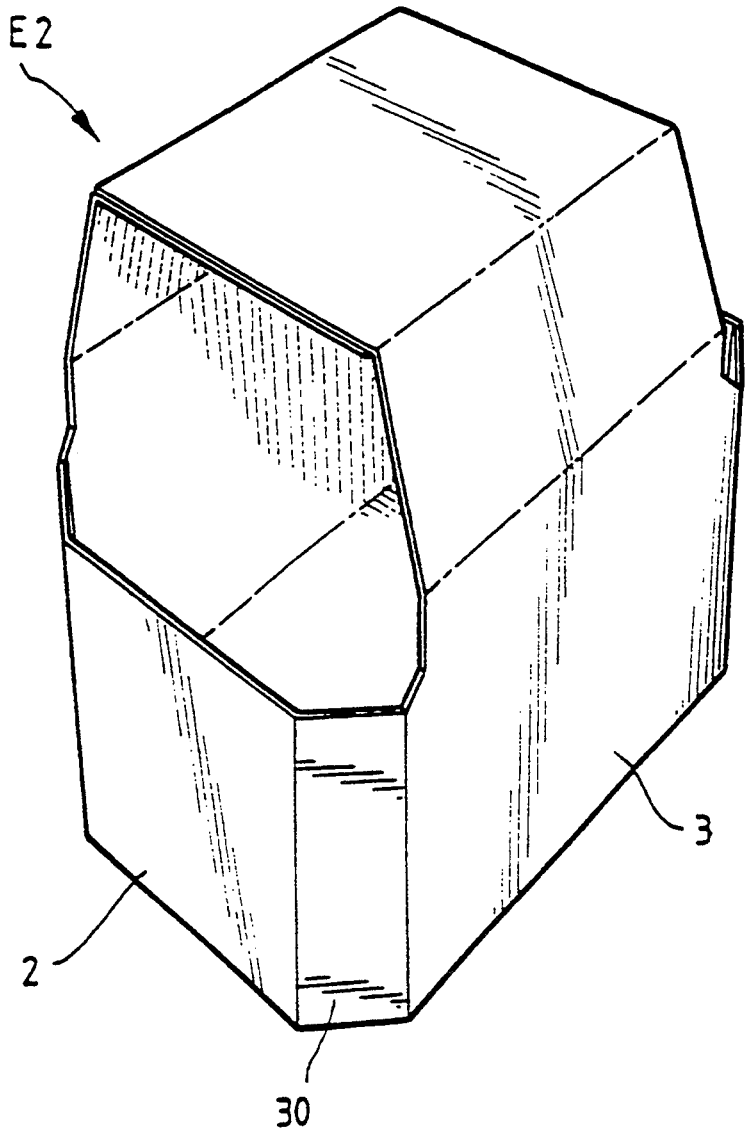
FIG. 6 is a view in perspective from above of an embodiment variant of the packaging in accordance with the present invention, comprising cut-off corners.

In the packaging E2, in accordance with the present invention and shown by FIG. 6, the base no longer has a rectangular section as in the packagings E1 and E1' described hereinabove, but has an octagonal section, as a result of the lateral corners of the packaging being cut off.

Figure 7:
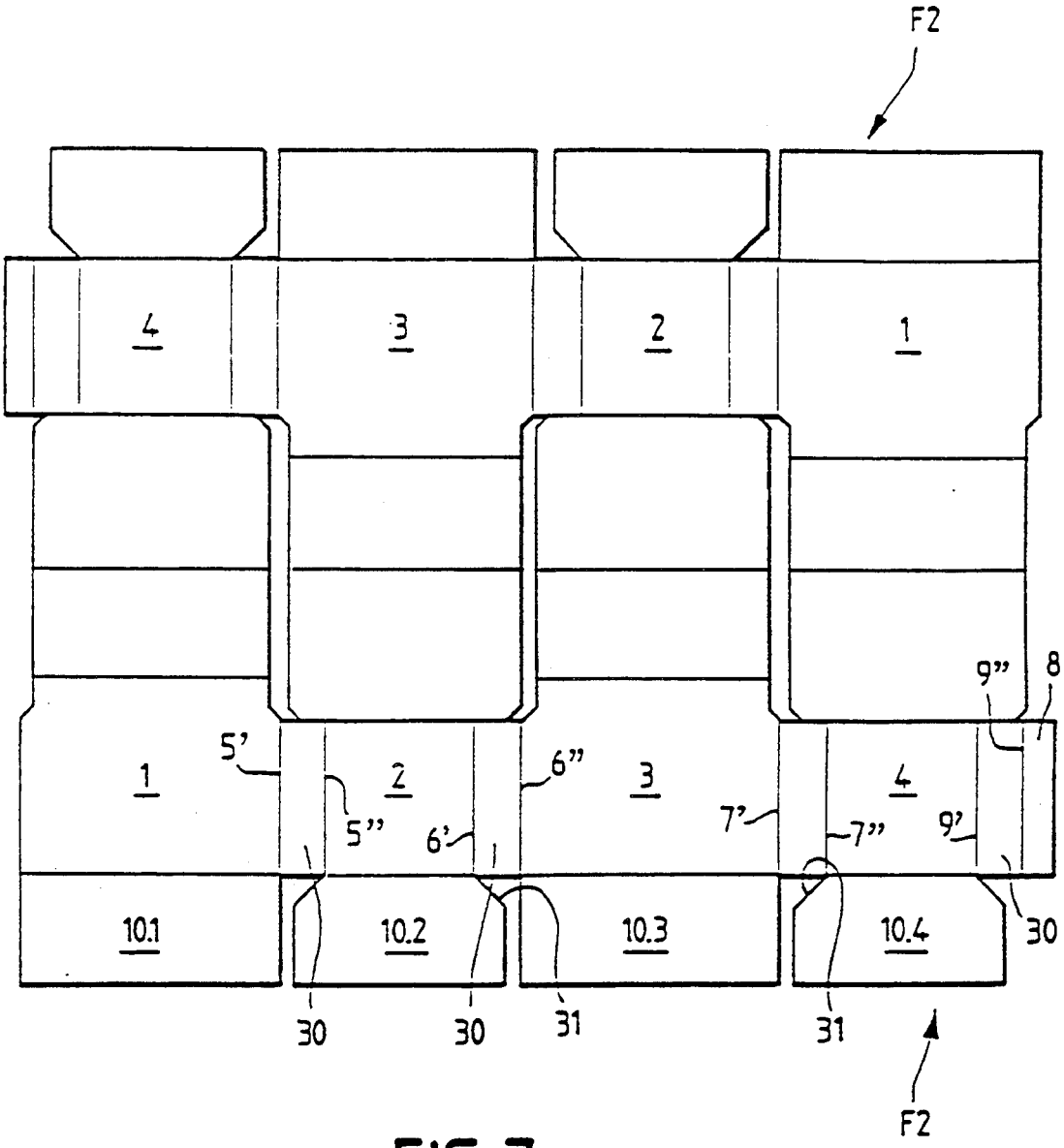
FIG. 7 shows, laid flat and arranged in an interfitted manner, two cardboard blanks, each of which makes it possible to produce the packaging of FIG. 6.

For this purpose, as shown in FIG. 7 which is similar to FIG. 3, each of the blanks F2 intended to form a packaging E2 comprises additional narrow flaps 30, respectively interposed between the flaps 1 and 2, 2 and 3, 3 and 4, and 4 and 1. Folding lines 5',5''-6',6''-7',7'' and 9',9'' similar to the folding lines 5 to 9, connect the narrow flaps 30 to the flaps 1 to 4.

No tabs similar to tabs 10.1 and 10.4 are associated with the narrow flaps 30. In the example of FIG. 7, the large tabs 10.1 and 10.3 remain at least substantially rectangular, while, in the vicinity of the folding lines connecting them to the corresponding flap 2 or 4, the small tabs 10.2 and 10.4 have the shape of the section of the octagonal packaging E2, that is to say comprising widening parts 31.

The blanks F2 of the FIG. 7 are interfitted by their protruding flaps 1 and 3, but cannot be interfitted by their tabs 10.1 to 10.4.

Figure 8:
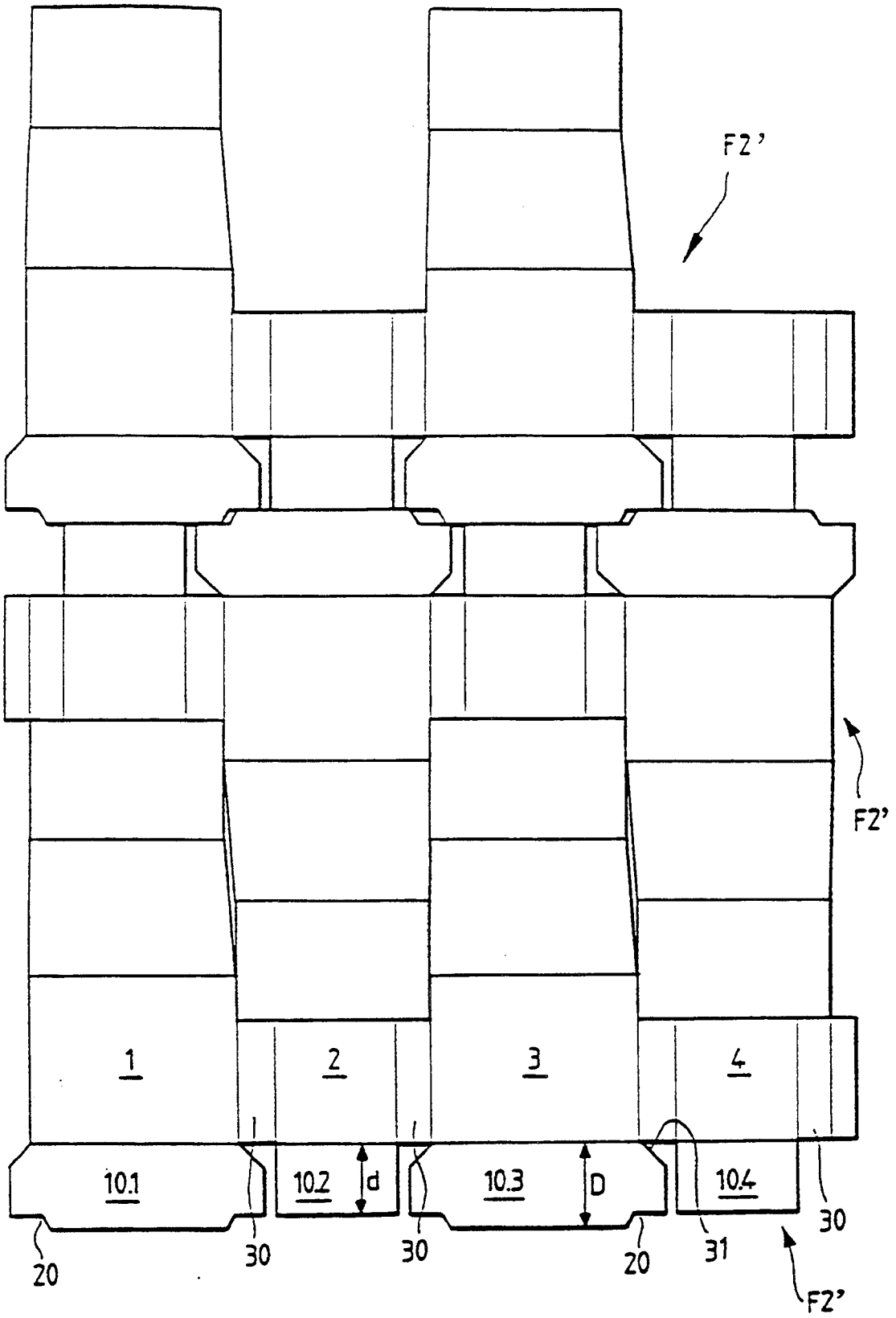
FIG. 8 shows, laid flat and arranged in an interfitted manner, three cardboard blanks different from those of FIG. 7, each of which makes it possible to produce a packaging which is slightly different from that of FIG. 6.

In the embodiment variant F2' of FIG. 8 (which is similar to FIG. 4), the blanks F2' can be interfitted by their flaps and by their tabs, since the width d of the tabs 10.2 and 10.4 is less than the width D of the tabs 10.1 and 10.3 and the ends of these tabs are provided with cut-outs 20 in their free edges.

It will be noted that, in the example of FIG. 8, the widening part 31 is borne by the large tabs 10.1 and 10.3 and no longer by the small tabs 10.2 and 10.4.

Figure 9:
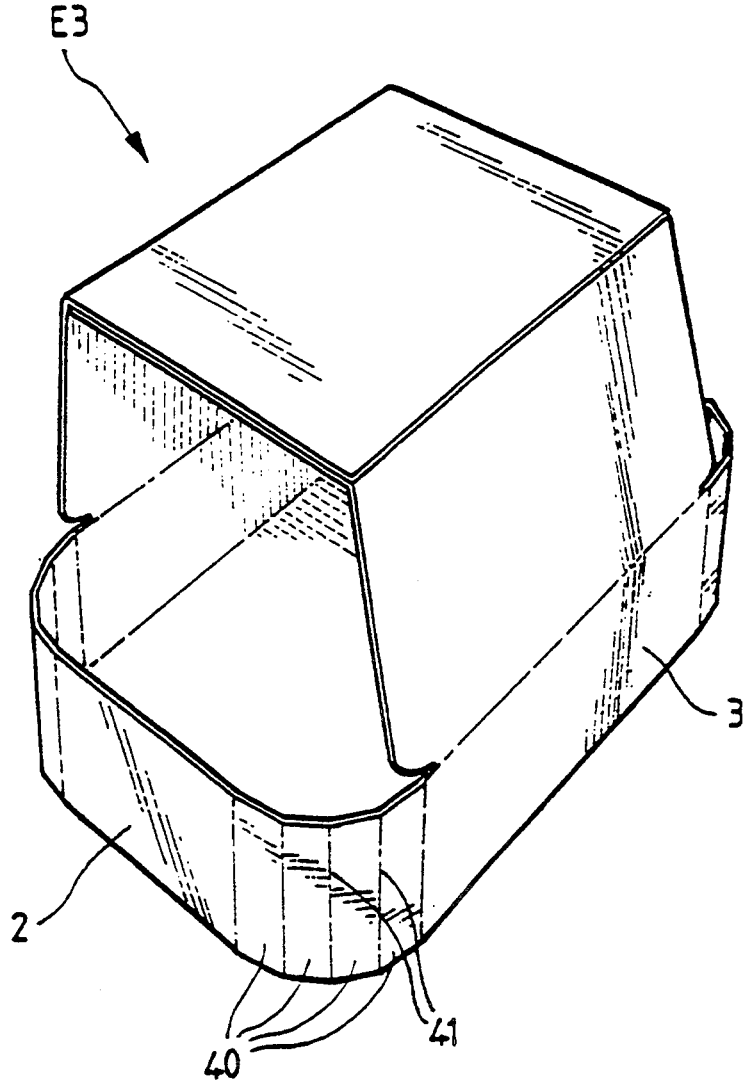
FIG. 9 is a view in perspective from above of an embodiment variant of the packaging in accordance with the present invention, comprising rounded corners.
Figure 10:
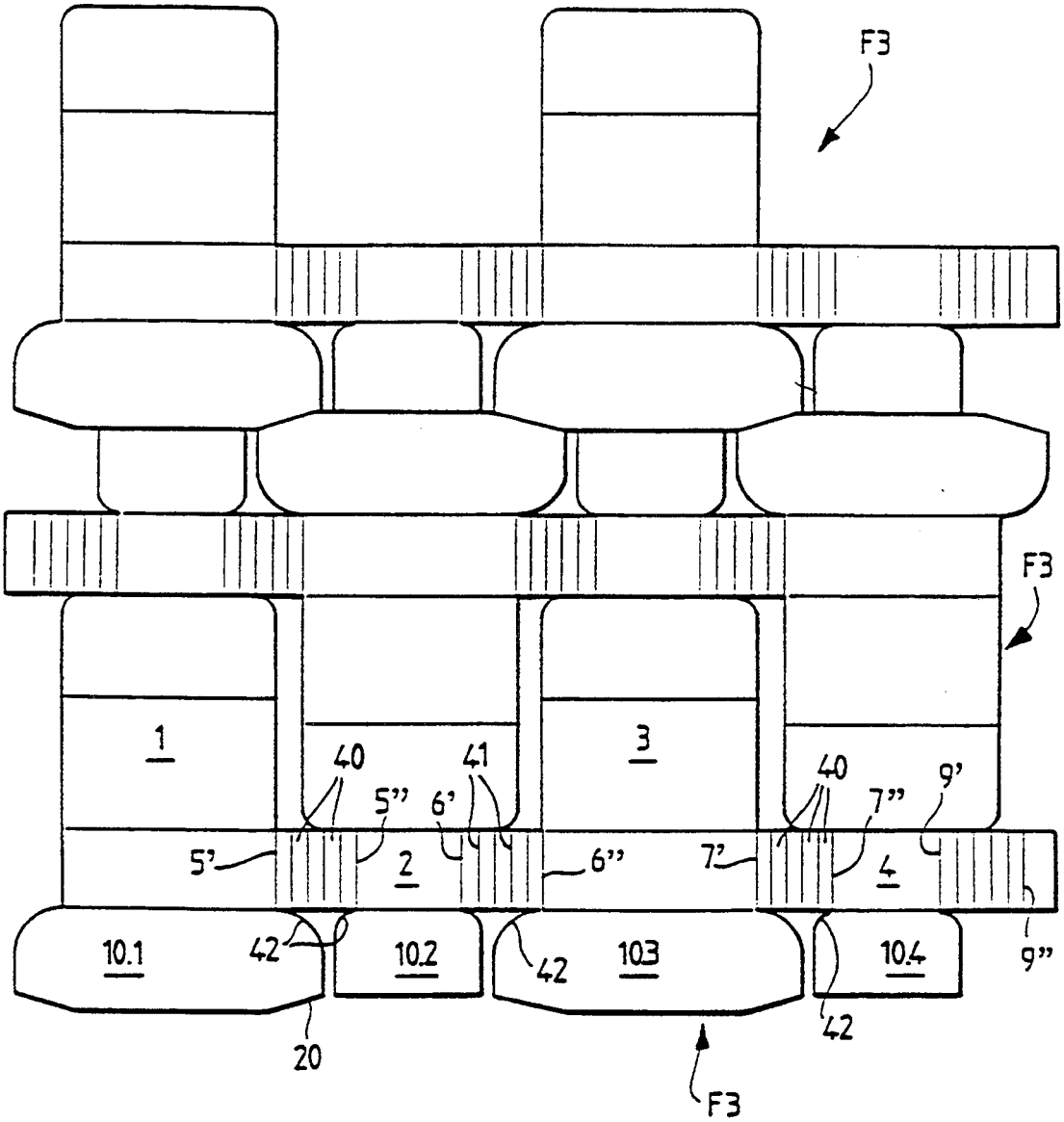
FIG. 10 shows, laid flat and arranged in an interfitted manner, three cardboard blanks, each of which makes it possible to produce the packaging of FIG. 9.

In the packaging E3, in accordance with the present invention and shown by FIG. 9, the corners of the base are rounded. As shown by FIG. 10, which is similar to FIGS. 4 and 8, each of the blanks F3 intended to form a packaging E3 comprises groups of small intermediate flaps 40, respectively interposed between the flaps 1 and 2, 2 and 3, 3 and 4 and 4 and 1. In a group of flaps 40, these flaps are hinged to each other by folding lines 41 Folding lines 5',5''-6',6''-7',7'' and 9',9'', similar to the folding lines 5 to 9, connect each group of flaps 40 to the said flaps 1 to 4.

Each of the tabs 10.1 to 10.4 comprises rounded widening parts 42, in the vicinity of the folding line connecting it to the corresponding flap, in order to be able to fit the rounded shape of the corners of the packaging E3.

It will be noted that the cut-out 20 of the large tabs 10.1 and 10.3 is formed by cutting the corners of the latter slantwise.

It goes without saying that the said cut-outs 20 can have any suitable shape enabling the tabs 10.1 to 10.4 to be interfitted. These cut-outs can have a curved outline or can consist of a straight line segment or segments.

We claim:

1. Packaging which is approximately parallelepipedal shaped and which is formed from a flat sheet-type material, comprising:

two first and two second lateral faces which are substantially rectangular, formed as identical opposite pairs, and connected together via first parallel folding lines, the first faces having a height parallel to the first folding lines which is greater than a height of the second faces, and the first faces having protruding parts which protrude relative to the second faces in a height direction parallel to the first folding lines, the protruding parts having a width perpendicular to the first folding lines which is less than a peripheral distance of the package separating the protruding parts;

a bottom which is formed by two first and two second tabs connected to respective ones of the first and second lateral faces by second folding lines orthogonal to the first folding lines, the first tabs being respectively attached to a respective first face along an entire length of the respective second folding line, with each first tab having a respective first free edge located opposite to the associated second folding line and opposed first lateral edges between the associated first free edge and the associated second folding line, the two second tabs respectively attached to a respective second face along an entire length of the respective second folding line, with each second tab having a respective second free edge located opposite to the associated second folding line and opposed second lateral edges between the associated second free edge and the associated second folding line, and the two first tabs being contiguous along the first free edges so that the two first tabs form substantially an entire exterior surface of the bottom, with the second tabs located internally and adjacent the first tabs; and a lid which is formed by third tabs connected to respective protruding parts of the first faces by third folding lines which third folding lines are orthogonal to the first folding lines.

2. Packaging as claimed in claim 1 wherein a distance between the second free edge and the second folding line of each second tab is less than a distance between the first free edge and the second folding line of each first tab.

3. Packaging as claimed in claim 1 wherein said first tabs include cutouts in the first free edges adjacent the first lateral edges.

4. Packaging as claimed in claim 1 wherein a length of said first faces along the associated second folding line is greater than a length of said second faces along the associated second folding line.

5. Packaging as claimed in claim 1 wherein the flat sheet-type material from which the packaging is made is corrugated cardboard having a thickness of about 2 mm to 5 mm.

6. Packaging as claimed in claim 1 wherein the associated first and second faces are connected by a flap located between adjacent first folding lines such that a corner intersection of the associated first and second faces formed by the associated flap is angled.

7. Packaging as claimed in claim 1 wherein the associated first and second faces are connected by a series of flaps located between adjacent first folding lines such that a corner intersection of the associated first and second faces formed by the associated series of flaps is rounded.

8. A blank of sheet-type cardboard used for producing a packaging which is approximately parallelepipedal shaped, comprising:

a series four flaps comprising alternating first and second flaps which flaps are substantially rectangular and connected together via first parallel folding lines, the first flaps having a height parallel to the first folding lines which is greater than a height of the second flaps, and the first flaps having protruding parts which protrude relative to the second flaps in a height direction parallel to the first folding lines, the protruding parts having a width perpendicular to the first folding lines which is less than a parallel distance separating the protruding parts;

a first group of tabs attached to one side of the series of flaps, the first group comprising two first and two second tabs connected to respective ones of the first and second flaps by second folding lines orthogonal to the first folding lines which first and second tabs are used to form a bottom of the packaging, the first tabs being respectively attached to a respective first face along an entire length of the respective second folding line, with each first tab having opposed first lateral edges, and the two second tabs respectively attached to a respective second face along an entire length of the respective second folding line, with each second tab having opposed second lateral edges, the second lateral edges being free from the adjacent first lateral edges; and a second group of third tabs attached to another side of respective first flaps along respective third folding lines which third folding lines are orthogonal to the first folding lines, the third tabs being used to form a lid of the packaging.

9. A blank as claimed in claim 8 wherein a width of the second tabs perpendicular to the second folding lines is less than a width of the first tabs perpendicular to the second folding lines.

10. A blank as claimed in claim 8 wherein the flat sheet-type cardboard is corrugated and has a thickness of about 2 mm to 5 mm.

11. A blank as claimed in claim 8 wherein a length of said first flaps along the associated second folding line is greater than a length of said second flaps along the associated second folding line.

12. A blank as claimed in claim 8 wherein said first tabs include cutouts in respective first free edges adjacent the first lateral edges.

13. A blank as claimed in claim 12 wherein said cutouts have a length parallel to the second folding lines which is at most equal to a width of the second tabs parallel to the first folding lines.

14. A blank as claimed in claim 8 and further including at least one narrow flap provided between adjacent ones of the series of four flaps and on one side of the series of four flaps whereby a package with non-rectangular corners is provided by the blank.

15. A blank as claimed in claim 14 wherein there is a single narrow flap between each of the series of four flaps and on one side of the series of four flaps so that the non-rectangular corner is angled, and wherein at least one of said first and second tabs have the lateral edges thereof adjacent the first folding line angled according to the angled corner being provided.

16. A blank as claimed in claim 14 wherein there is a series of narrow flaps between each of the series of four flaps and on one side of the series of four flaps so that the non-rectangular corner is rounded, and wherein at least one of said first and second tabs have the lateral edges thereof adjacent the first folding line rounded according to the rounded corner being provided.

17. A blank as claimed in claim 8 wherein a width of said first flaps along the associated second folding line is greater than a width of said second flaps along the associated second folding line.

* * * * *